US009726180B2

(12) United States Patent
Akiyama et al.

(10) Patent No.: US 9,726,180 B2
(45) Date of Patent: Aug. 8, 2017

(54) CENTRIFUGAL PUMP

(71) Applicant: HONDA MOTOR CO., LTD., Tokyo (JP)

(72) Inventors: Naohiro Akiyama, Wako (JP); Kaku Okabe, Wako (JP)

(73) Assignee: HONDA MOTOR CO., LTD., Tokyo (JP)

( * ) Notice: Subject to any disclaimer, the term of this patent is extended or adjusted under 35 U.S.C. 154(b) by 362 days.

(21) Appl. No.: 14/476,877

(22) Filed: Sep. 4, 2014

(65) Prior Publication Data

US 2015/0071774 A1 Mar. 12, 2015

(30) Foreign Application Priority Data

Sep. 6, 2013 (JP) ..... 2013-185083

(51) Int. Cl.
*F04D 29/44* (2006.01)
*F04D 9/00* (2006.01)
(Continued)

(52) U.S. Cl.
CPC ..... *F04D 9/002* (2013.01); *F04D 9/02* (2013.01); *F04D 29/167* (2013.01);
(Continued)

(58) Field of Classification Search
CPC ..... F04D 9/002; F04D 9/02; F04D 29/167; F04D 29/426; F04D 29/448; F05D 2240/126
(Continued)

(56) References Cited

U.S. PATENT DOCUMENTS 2,250,714 A * 7/1941 La Bour ..... F04D 9/02 277/429
2,287,397 A * 6/1942 Rupp ..... F04D 1/006 415/214.1
(Continued)

FOREIGN PATENT DOCUMENTS

CN 1334407 A 2/2002
CN 101865160 A 10/2010
(Continued)

OTHER PUBLICATIONS

Office Action dated May 5, 2016, issued in counterpart Chinese Patent Application No. 201410452651.4. (6 pages).
(Continued)

*Primary Examiner* — Kenneth Bomberg
*Assistant Examiner* — Brian Delrue
(74) *Attorney, Agent, or Firm* — Westerman, Hattori, Daniels & Adrian, LLP

(57) ABSTRACT

A volute of a centrifugal pump includes a proximate section. The proximate section includes: an outer peripheral portion having a tapered shape such that, within a range of a rotational trajectory of each of vanes provided on an impeller, the outer peripheral portion gradually spreads out in a direction axially away from the vane; and an inner peripheral portion having a tapered shape such that, within the range of the rotational trajectory of each of the vanes, the inner peripheral portion tapers in the direction axially away from the vane. The inner and outer peripheral portions are spaced apart from each other with a flat proximal opposed surface portion therebetween. The opposed surface portion is opposed to respective axial end surfaces of vanes of the impeller. The volute also includes a peripheral wall surrounding the peripheral surfaces of the vanes.

2 Claims, 10 Drawing Sheets

(51) Int. Cl.
*F04D 9/02* (2006.01)
*F04D 29/16* (2006.01)
*F04D 29/42* (2006.01)

(52) U.S. Cl.
CPC ..... *F04D 29/426* (2013.01); *F04D 29/448* (2013.01); *F05D 2240/126* (2013.01)

(58) Field of Classification Search
USPC ..... 415/204; 55/471
See application file for complete search history.

(56) References Cited

U.S. PATENT DOCUMENTS 2,759,662 A * 8/1956 Carrier ..... F04D 17/122 415/199.2
3,363,832 A * 1/1968 Groff ..... F04D 29/281 415/119
3,960,333 A * 6/1976 Woods ..... F04D 7/045 241/174
4,565,489 A * 1/1986 Haide ..... F04D 9/02 415/56.1
4,717,314 A * 1/1988 Sato ..... F04C 18/0215 417/310
5,112,190 A * 5/1992 Kajiwara ..... F04D 29/4266 415/108
5,366,358 A * 11/1994 Grenci ..... F04C 18/0207 277/402
5,807,088 A * 9/1998 Fukanuma ..... F04C 18/0284 418/55.2
6,017,187 A * 1/2000 Mueller ..... F04D 29/428 415/208.1
6,220,819 B1 * 4/2001 Chien ..... F04D 29/2222 416/186 R
8,202,046 B2 * 6/2012 Buell ..... F04D 9/008 415/173.4
2004/0067133 A1 * 4/2004 Ishigaki ..... F04D 1/025 415/219.1
2011/0008185 A1 * 1/2011 Metcalfe ..... F04D 29/28 417/234
2012/0003108 A1 * 1/2012 Ozaki ..... A61M 1/101 417/413.1
2012/0253103 A1 * 10/2012 Robert ..... A61M 1/101 600/16
2013/0017078 A1 * 1/2013 Armstrong ..... F04D 29/162 415/204
2014/0169940 A1 * 6/2014 Yokota ..... F04D 9/005 415/56.1
2014/0219790 A1 * 8/2014 Houst ..... F01D 9/026 415/208.1
2015/0071773 A1 * 3/2015 Takahashi ..... F04D 29/4293 415/204

FOREIGN PATENT DOCUMENTS

FR 2640328 A1 6/1990
GB 582355 A 11/1946
IT EP 1219838 A2 * 7/2002 ..... F04D 1/063
JP S55-69184 U 5/1980
JP 58-67992 A 4/1983
JP 03-122295 U 12/1991
JP 2008-050958 A 3/2008
JP 2012-72697 A 4/2012
WO 2005/010374 A1 2/2005

OTHER PUBLICATIONS

Office Action dated Aug. 23, 2016, issued in counterpart Japanese Patent Application No. 2013-185083, with English translation. (9 pages).

* cited by examiner (b) INVENTIVE EMBODIMENT (a) CONVENTIONALLY-KNOWN EXAMPLE

CENTRIFUGAL PUMP

TECHNICAL FIELD

The present disclosure relates to centrifugal pumps which include an impeller within a volute and in which fluid sucked into the volute by rotation of the impeller is sent out along the volute and the sent-out fluid is discharged to outside of the centrifugal pump.

BACKGROUND

Among the conventionally-known centrifugal pumps are ones in which a rotation shaft rotatably projects into a volute and an impeller is mounted on the projecting rotation shaft. Such centrifugal pumps are adjustable in performance by fluid being caused to flow into a flow passage defined by the volute, as disclosed, for example, in Japanese Patent Application Laid-Open Publication No. 2012-72697 (hereinafter referred to as "the relevant patent literature").

In the centrifugal pump disclosed in the relevant patent literature, the volute is disposed within a pump casing, and the impeller is rotatably accommodated within the volute. The volute has a surface opposed to respective one end surfaces in a rotation axis direction (i.e., respective one axial end surfaces) of vanes provided on the impeller, and a peripheral wall section extending from the outer peripheral edge of the volute's opposed surface to surround the outer periphery of the impeller. Fluid is sucked in through a suction opening formed centrally in the opposed surface, and the impeller is rotated so that, by centrifugal force, the fluid is discharged into the pump casing through a discharge opening formed in the peripheral wall section.

Although the flow passage is formed inside the volute, backward or reverse flows of the fluid are prevented by locating the axial end surfaces of the vanes and the volute's opposed surface close to each other. In order to increase a flow rate of the fluid and thereby enhance the performance of the centrifugal pump, there may be employed an approach of increasing the sectional area of the in-volute flow passage and/or increasing the diameter of the impeller. The sectional area of the in-volute flow passage can be increased by increasing a dimension of the volute in a radially outward direction so that the peripheral wall section is located more radially outward or locating the opposed surface of the volute higher in the axial direction.

If the peripheral wall section of the volute is located more radially outward and/or the opposed surface of the volute is located higher in the axial direction, however, the volute and the pump casing would interfere with each other. If the pump casing is increased in size to avoid such interference, the centrifugal pump would increase in overall size. Further, if the volute is increased in dimension in the axial direction of the rotation shaft rather than in the radially outer direction, the sectional area of the in-volute flow passage cannot be used effectively. Thus, some improvement has to be made in order to increase the flow rate while maintaining the size of the volute (i.e., without changing the size of the volute).

SUMMARY

In view of the foregoing problems, it is preferable to provide an improved technique which permits an increased flow rate within a volute of a centrifugal pump and thereby permits enhanced self-priming of the pump while maintaining the overall size of the volute.

In order to accomplish the above, one aspect of the present disclosure provides an improved centrifugal pump which comprises: a volute provided within a pump casing; and an impeller rotatably provided within the volute, wherein fluid sucked into the volute by rotation of the impeller is sent out from the volute into the pump casing and then discharged to outside of the pump casing, and in which the impeller has a plurality of vanes provided thereon in a radial arrangement about a rotation shaft that rotates the impeller, the volute has a generally flat opposed surface that is opposed to respective axial end surfaces (i.e., end surfaces in the axial direction of the rotation shaft) of the plurality of vanes, the opposed surface having a proximate section that is proximate to the axial end surface of each of the vanes, the proximate section having an annular shape and being disposed about the rotation shaft. Further, the proximate section includes an outer peripheral portion having a tapered shape such that, within a range of a rotational trajectory of each of the vanes, the outer peripheral portion gradually spreads out in a direction axially away from the vane, i.e. with an increasing distance from the vane.

Moreover, the generally flat opposed surface of the volute is opposed to the respective axial end surfaces of the plurality of vanes, the proximate section of the opposed surface is proximate to the axial end surface of each of the vanes, and the proximate section having an annular shape is disposed about the rotation shaft. Further, the proximate section includes the outer peripheral portion has a tapered shape such that, within the range of the rotational trajectory of each of the vanes, the outer peripheral portion gradually spreads out in a direction axially away from the vane. With such arrangements, the present disclosure can provide an increased flow-passage sectional area of the outer peripheral portion. Further, with the outer peripheral portion having such a tapered shape, the flow passage can be changed in direction smoothly, not at a steep angle. As a result, the present disclosure permits efficient use of a space inside the volute and an increased flow rate within the volute while maintaining the overall size of the volute (i.e., without changing the overall size of the volute). Further, priming water can be fed through a discharge opening of the outer peripheral portion with an increased ease, so that gas-liquid agitation can be promoted to achieve enhanced self-priming.

In an embodiment of the present invention, the proximate section includes an inner peripheral portion having a tapered shape such that, within the range of the rotational trajectory of each of the vanes, the inner peripheral portion tapers in the direction axially away from the vane, and the inner peripheral portion and the outer peripheral portion are spaced apart from each other. Because the inner peripheral portion of the proximate section has a tapered shape such that, within the range of the rotational trajectory of each of the vanes, it gradually tapers in the direction axially away from the vane, the inner peripheral portion can provide an increased flow-passage sectional area. Further, with the inner peripheral portion having such a tapered shape, the flow passage can be changed in direction smoothly, not at a steep angle. As a result, the embodiment permits efficient use of the space inside the volute and an increased flow rate within the volute to thereby realize even further enhanced self-priming. Further, because the inner peripheral portion and the outer peripheral portion are spaced apart from each other, the proximate section disposed within the range of the rotational trajectory of each of the vanes can reliably prevent the fluid from flowing backward. As a result, the embodiment can prevent variation in discharge pump head.

Further, of the proximate section, the outer peripheral portion having the tapered shape has a plurality of fins provided thereon in a radial arrangement about the rotation shaft and projecting toward the impeller. Because the fins are provided in a radial arrangement about the rotation shaft, the fluid can be straightened by the fins, so that flows of the fluid can be smoothed. As a result, the present disclosure can lower resistance of the flow passage and reduce a load on a drive source that rotates the impeller.

The following will describe embodiments of the present invention, but it should be appreciated that the present invention is not limited to the described embodiments and various modifications of the invention are possible without departing from the basic principles. The scope of the present invention is therefore to be determined solely by the appended claims.

BRIEF DESCRIPTION OF THE DRAWINGS

Certain preferred embodiments of the present invention will hereinafter be described in detail, by way of example only, with reference to the accompanying drawings, in which.

DETAILED DESCRIPTION

Figure 1:
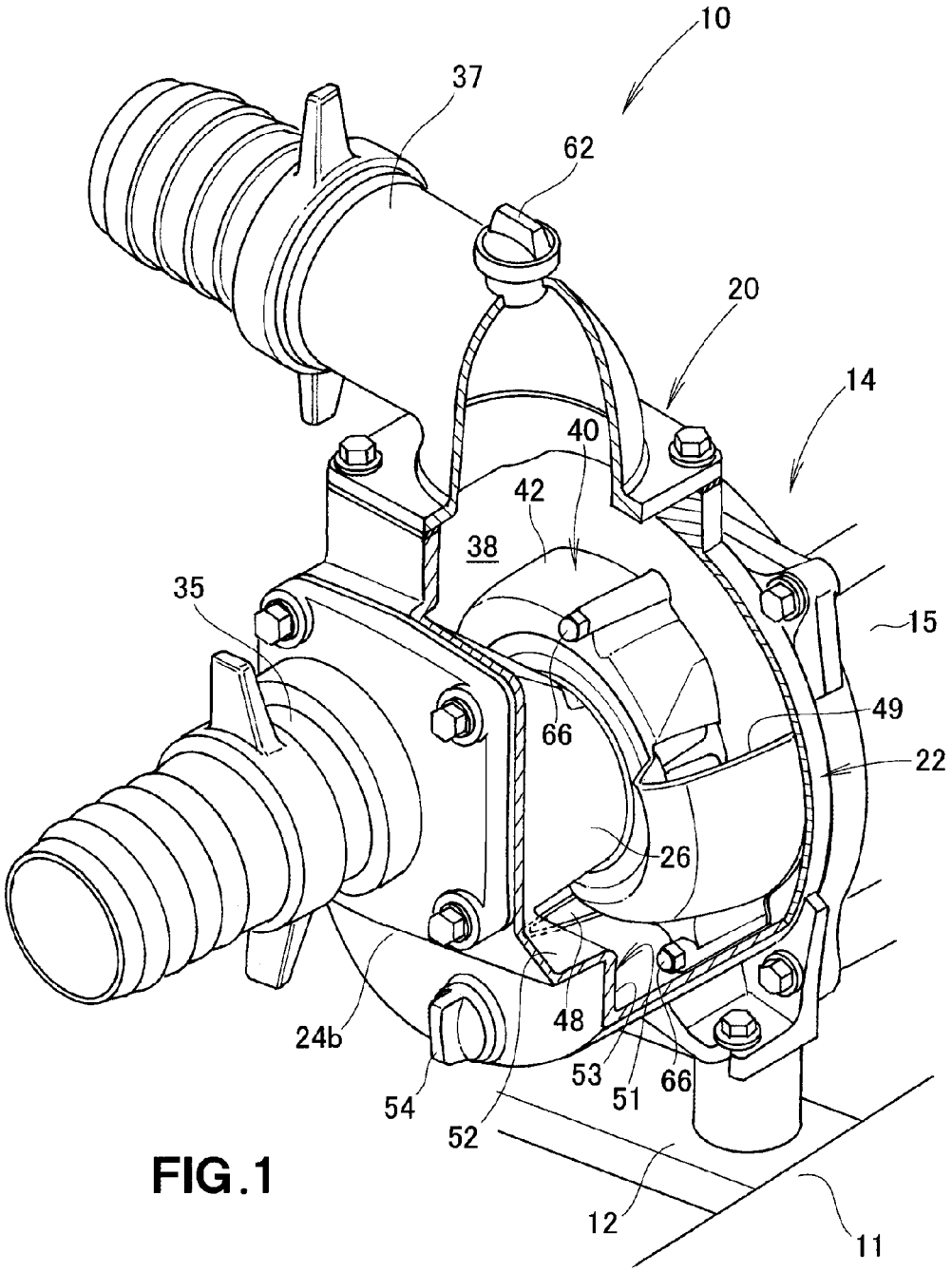
FIG. 1 is a perspective view showing a centrifugal pump according to a first embodiment of the present invention.
Figure 2:
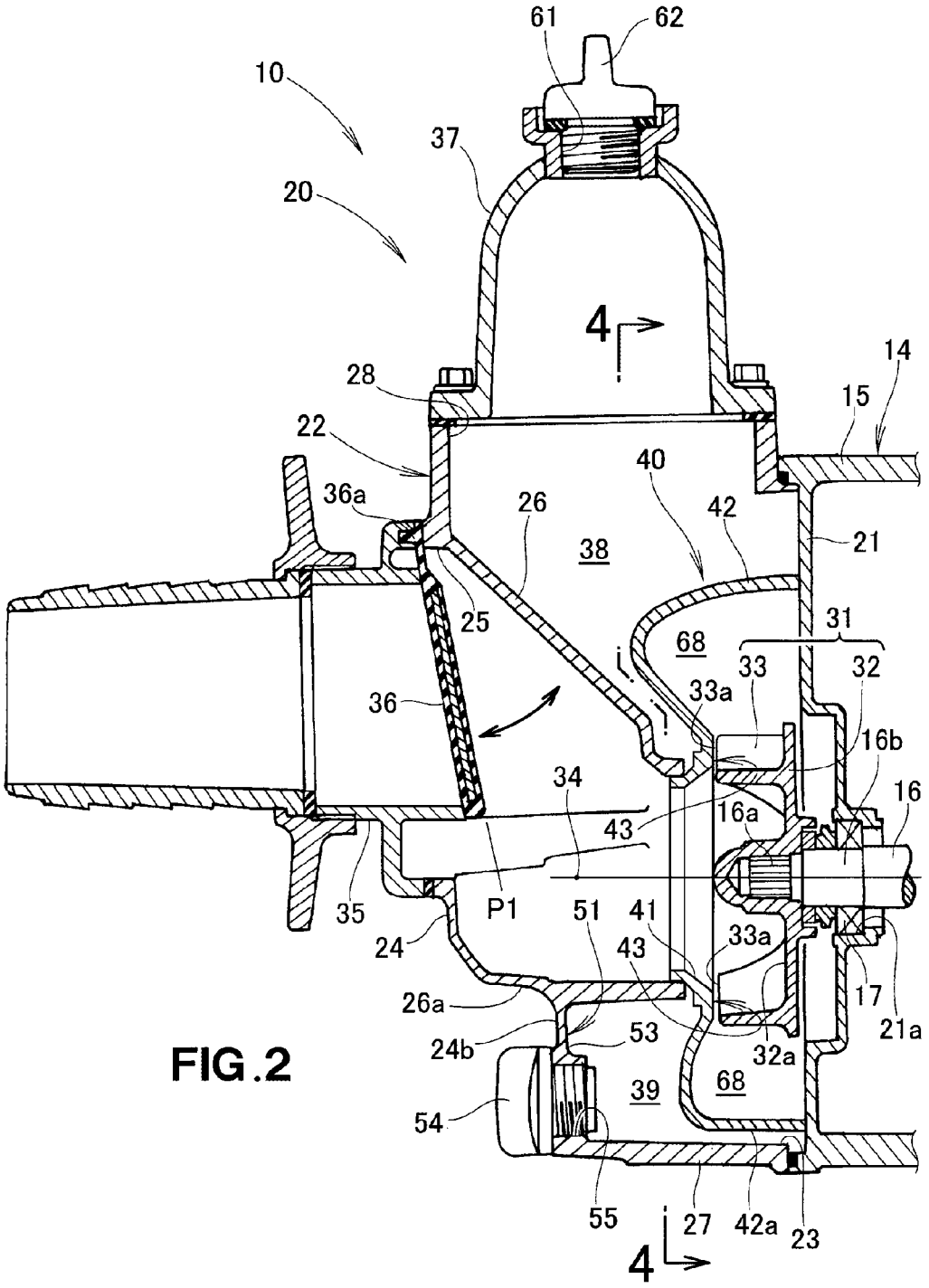
FIG. 2 is a sectional view of the centrifugal pump shown in FIG. 1.

Now, a description will be given about a first embodiment of a centrifugal pump 20 of the present invention. As shown in FIGS. 1 and 2, a centrifugal pump unit 10 includes a frame 11 formed to cover an engine 14 and the centrifugal pump 20, and the centrifugal pump 20 mounted on a base 12 of the frame 11.

The engine 14 includes a cylinder block 15 mounted on the base 12, a pump casing 22 of the centrifugal pump 20 is mounted on the cylinder block 15, and a crankshaft 16 has an end portion 16*a* projecting from the cylinder block 15 into the pump casing 22.

Of the crankshaft 16, a portion 16*b* located near the end portion 16*a* (i.e., near-end portion 16*b*) is rotatably supported on a mechanical seal 17, and the end portion 16*a* is connected to an impeller 31 of the centrifugal pump 20. Thus, the impeller 31 is rotatable by the crankshaft 16 (hereinafter also referred to as "rotation shaft 16") being rotated by activation of the engine 14.

The centrifugal pump 20 includes the pump casing 22 bolted to the cylinder block 15 via a partition member 21, the impeller 31 provided within the pump casing 22 and connected to the end portion 16*a* of the rotation shaft 16, and a volute 40 covering the impeller 31.

Further, the centrifugal pump 20 has a suction nozzle 35 communicating with a suction opening 25 of the pump casing 22 (i.e., casing suction opening 25), an opening/closing section 36 having an upper end portion 36*a* sandwiched between the pump casing 22 and the suction nozzle 35, and a discharge nozzle 37 communicating with a discharge opening 28 of the pump casing 22 (i.e., casing discharge opening 28).

The pump casing 22 has a casing opening section 23 closed with the partition member 21, and the volute 40 is provided on the partition member 21. Thus, an in-casing flow passage 38 is defined with the pump casing 22, the partition member 21 and the volute 40. Particularly, the in-casing flow passage 38 is defined in a substantially annular shape between the pump casing 22 and the volute 40.

Figure 3:
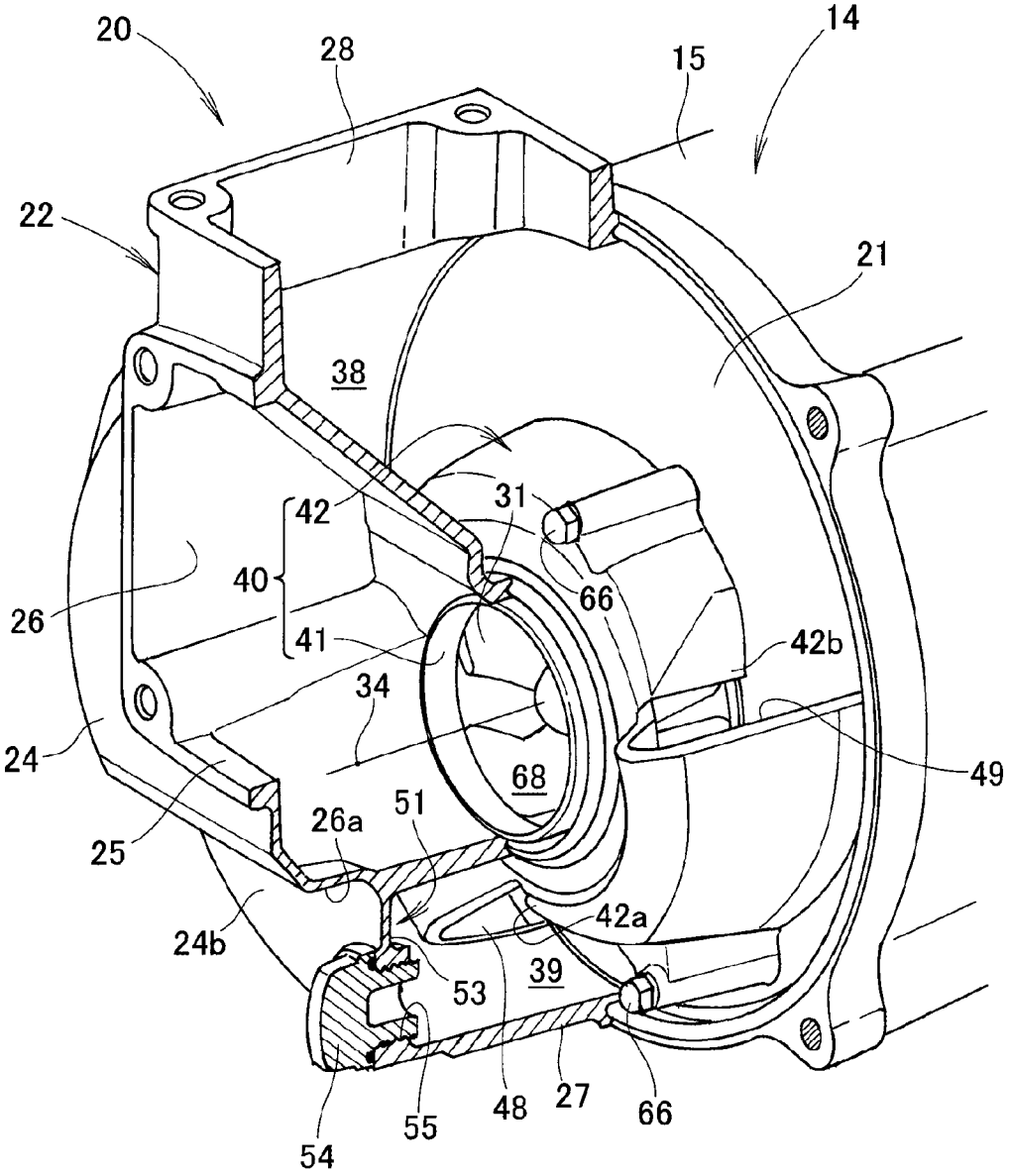
FIG. 3 is a partially-cutaway perspective view of a pump casing shown in FIG. 1.

As shown in FIGS. 2 and 3, the pump casing 22, having the casing opening section 23 closed with the partition member 21, further has: a suction-side wall section 24 facing the partition member 21; the casing suction opening 25 formed in the suction-side wall section 24; a suction passage portion 26 communicating with the casing suction opening 25; a peripheral wall section 27 formed in an annular (cylindrical) shape along side edges of the suction-side wall section 24; and the casing discharge opening 28 disposed above the peripheral wall section 27.

The suction-side wall section 24 includes a projection 51 projecting downward from a lower portion 24*b* of the wall section 24, i.e. a lower part 26*a* of the suction passage portion 26. The projection 51 projects (bulges) laterally from the lower portion 24*b* of the suction-side wall section 24 toward the in-casing flow passage 38. By the projection 51 formed integrally with the lower portion 24*b* of the suction-side wall section 24, the pump casing 22, and hence the centrifugal pump 20, can be reduced in weight and size as compared to a case where the projection 51 is formed as a separate member from the lower portion 24*b* of the suction-side wall section 24.

As shown in FIGS. 1 to 4, the projection 51 includes a top section 52 extending horizontally from the lower portion 24*b* of the suction-side wall section 24 toward the volute 40, and a wall section 53 extending vertically downward from the top section 52 to thereby face the volute 40.

Figure 4:
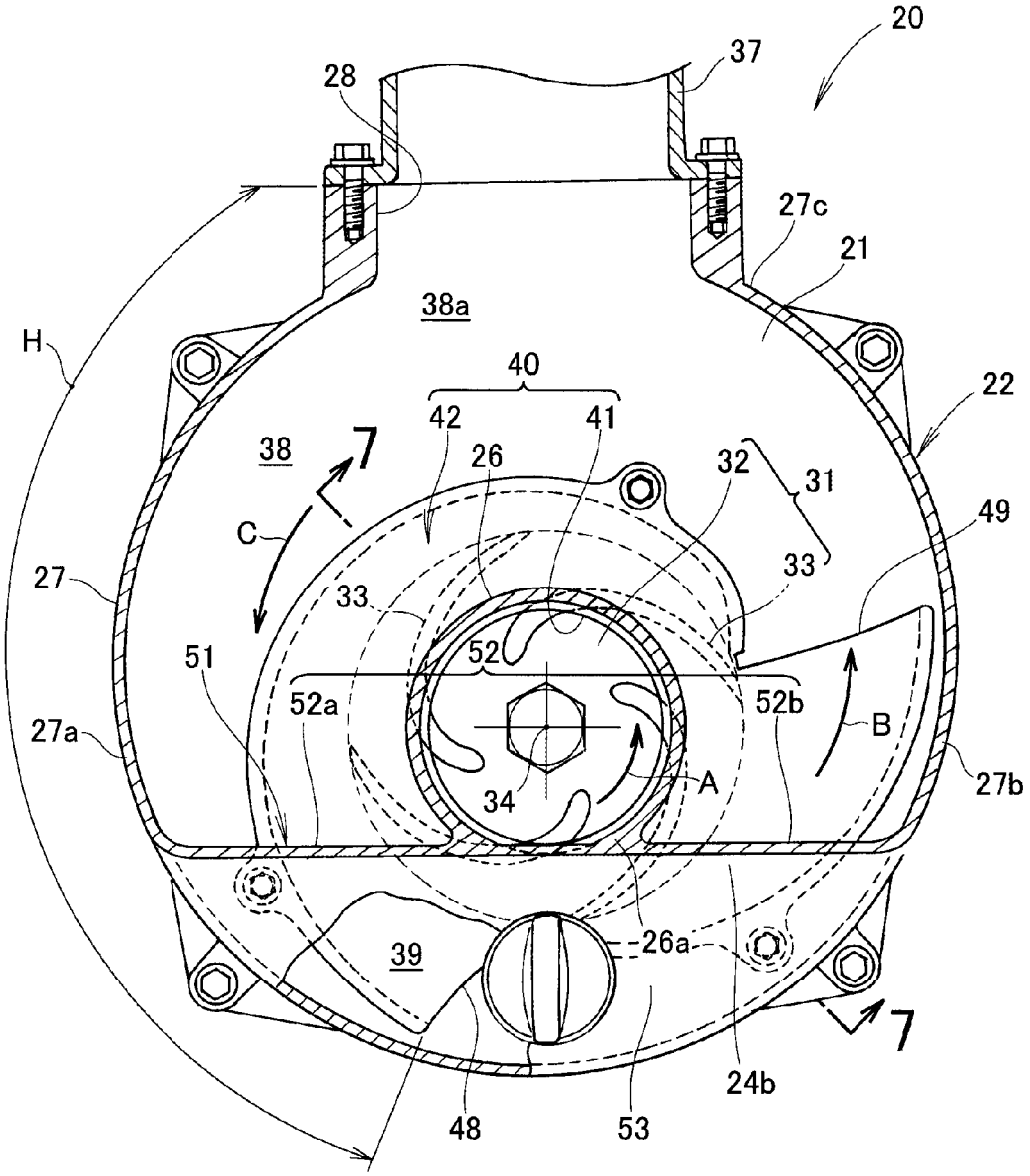
FIG. 4 is a sectional view taken along line 4-4 of FIG. 2.

As shown in FIG. 4 that is a sectional view taken along the 4-4 line of FIG. 2, the top section 52 includes an upstream top portion 52*a* disposed between the lower part 26*a* of the suction passage portion 26 and an upstream peripheral wall portion 27*a*, and a downstream top portion 52*b* disposed between the lower part 26*a* of the suction passage portion 26 and a downstream peripheral wall portion 27*b*. The upstream peripheral wall portion 27*a* defines a portion of the in-casing flow passage 38 located upstream of an opening 48 of the volute 40. The downstream peripheral wall portion 27*b* defines a portion of the in-casing flow passage 38 located downstream of the opening 48 of the volute 40.

The upstream top portion 52*a* is disposed in a range H downstream of the casing discharge opening 28 and upstream of the opening 48 of the volute 40. Preferably, the upstream top portion 52*a* is provided on the lower part 26*a* of the suction passage portion 26 in the range H.

Further, the wall section 53 extends downward from an edge portion of the top section 52 and has an upper edge portion formed straight along the top section 52 and a lower edge portion curved along a lower portion of the peripheral wall section 27; thus, the wall section 53 generally has a half-moon shape. The wall section 53 also has a drain hole 55 that is closed with a drain plug 54 screwed thereto.

Further, with the projection 51 provided on the lower part 24*b* of the suction-side wall section 24, a flow-passage narrowing portion 39 is formed in a lower portion of the in-casing flow passage 38, and the flow-passage narrowing portion 39 has a smaller sectional area than the remaining portions of the in-casing flow passage 38. Further, the flow-passage narrowing portion 39 is located beneath the rotation axis 34 of the impeller 31, more specifically beneath a suction opening 41 of the volute 40 (i.e., volute suction opening 41), and at generally the same height as the opening 48 of the volute 40. In this manner, the opening 48 of the volute 40 is in communication with the flow-passage narrowing portion 39.

Further, the casing suction opening 25 is provided in the suction-side wall section 24, and the suction passage portion 26 is in communication with the casing suction opening 25. The suction passage portion 26 is in communication with the volute suction opening 41. Further, the volute suction opening 41 is in communication with the suction nozzle 35 by way of the suction passage portion 26 and the casing suction opening 25.

Further, the pump casing discharge opening 28 is provided in an upper portion 27*c* of the peripheral wall section 27, and the discharge nozzle 37 is in communication with the pump casing discharge opening 28. A fluid feed opening 61 is provided in an upper end portion of the discharge nozzle 37 and located over the volute 40, and this fluid feed opening 61 is closed with a feed plug 62.

Further, the partition member 21 has a support hole 21*a* formed therein concentrically with the rotation shaft 16, and the mechanical seal 17 is concentrically supported in the support hole 21*a*, and the rotation shaft 16 (more specifically, the near-end portion 16*b*) is rotatably supported on the mechanical seal 17. Further, the end portion 16*a* of the rotation shaft 16 projects through the mechanical seal 17 into the volute 40. Thus, the mechanical seal 17 can mechanically prevent fluid present within the volute 40 from leaking outside via the near-end portion 16*b*.

The impeller 31 is mounted on the rotation shaft's end portion 16*a* projecting into the volute 40, so that the impeller 31 is disposed inside the volute 40. The impeller 31 includes a disk-shaped hub 32 mounted on the end portion 16*a*, and a plurality of vanes 33 provided on the hub 32 in a radial arrangement about the rotation shaft 16. The plurality of vanes 33 are provided on a surface portion 32*a* of the hub 32 opposite from the mechanical seal 17. The impeller 31 is accommodated inside the volute 40 by being covered with the volute 40.

The volute 40 is fixed to the partition member 21 by means of bolts 66. The volute 40 is a case member provided within the pump casing 22 and accommodating therein the impeller 31. An in-volute flow passage 68 is defined with the volute 40 and the partition member 21. The volute 40 includes the suction opening 41 provided in communication with the suction passage portion 26 of the pump casing 22, and a volute body 42 has a spiral shape and disposed around the suction opening 41 (impeller 31).

The volute body 42 has a generally flat opposed surface 43 that is opposed to respective end surfaces 33*a*, in a rotation axis direction, of the vanes 33 (i.e., respective axial end surfaces 33*a* of the vanes 33). The volute body 42 has the opening 48 formed in a lower end portion 42*a* thereof, and a volute discharge opening 49 formed in a left upper portion 42*b* thereof. The opening 48 is provided for directing priming fluid, present in the in-casing flow passage 38, into the volute 40 (i.e., into the in-volute flow passage 68).

During self-priming of the centrifugal pump 20, the priming fluid is fed through the fluid feed opening 61 into the in-volute flow passage 68 with the feed plug 62 removed. The priming fluid thus fed into the in-casing flow passage 38 is discharged through the volute discharge opening 39 together with gases present in the in-volute flow passage 68 and then directed into the in-casing flow passage 38. Note that the "priming fluid" is fluid that performs a pump-priming action during the self-priming operation of the centrifugal pump 20.

More specifically, during the self-priming, priming fluid fed to the in-casing flow passage 38 is sucked into the in-volute flow passage 68 through the volute opening 48 by the impeller 31 being rotated as indicated by arrow A. Gases present in the in-volute flow passage 68 are incorporated as air bubbles into the fluid sucked into the in-volute flow passage 68. The fluid containing such air bubbles is discharged through the volute discharge opening 49 as indicated by arrow B and directed to an upper portion 38*a* of the in-casing flow passage 38, so that the gases present as the air bubbles are separated from the priming fluid and discharged to outside of the centrifugal pump 20 through the casing discharge opening 28 and the discharge nozzle 37. Further, the fluid having the gases separated therefrom as above flows as indicated by arrow C.

During steady operation of the pump 20, on the other hand, fluid directed through the volute suction opening 41 into the in-volute flow passage 68 is discharged through the volute discharge opening 39 and directed into the in-casing flow passage 38. The opening/closing section 36 has the upper end portion sandwiched between the pump casing 22 and the suction nozzle 35, as noted above. The suction nozzle 35 opens or closes in response to the opening/closing section 36 pivoting in an arrowed direction of FIG. 2.

More specifically, during the steady operation of the pump 20, fluid is sucked through the volute suction opening 41 into the in-volute flow passage 68 by the impeller 31 being rotated in the direction of arrow A in FIG. 4. The fluid thus sucked into the in-volute flow passage 68 is discharged through the volute discharge opening 49 as indicated by arrow B. The fluid thus discharged through the volute discharge opening 49 into the in-casing flow passage 38 is sent through the casing discharge opening 28 to the discharge nozzle 37.

Figure 5:
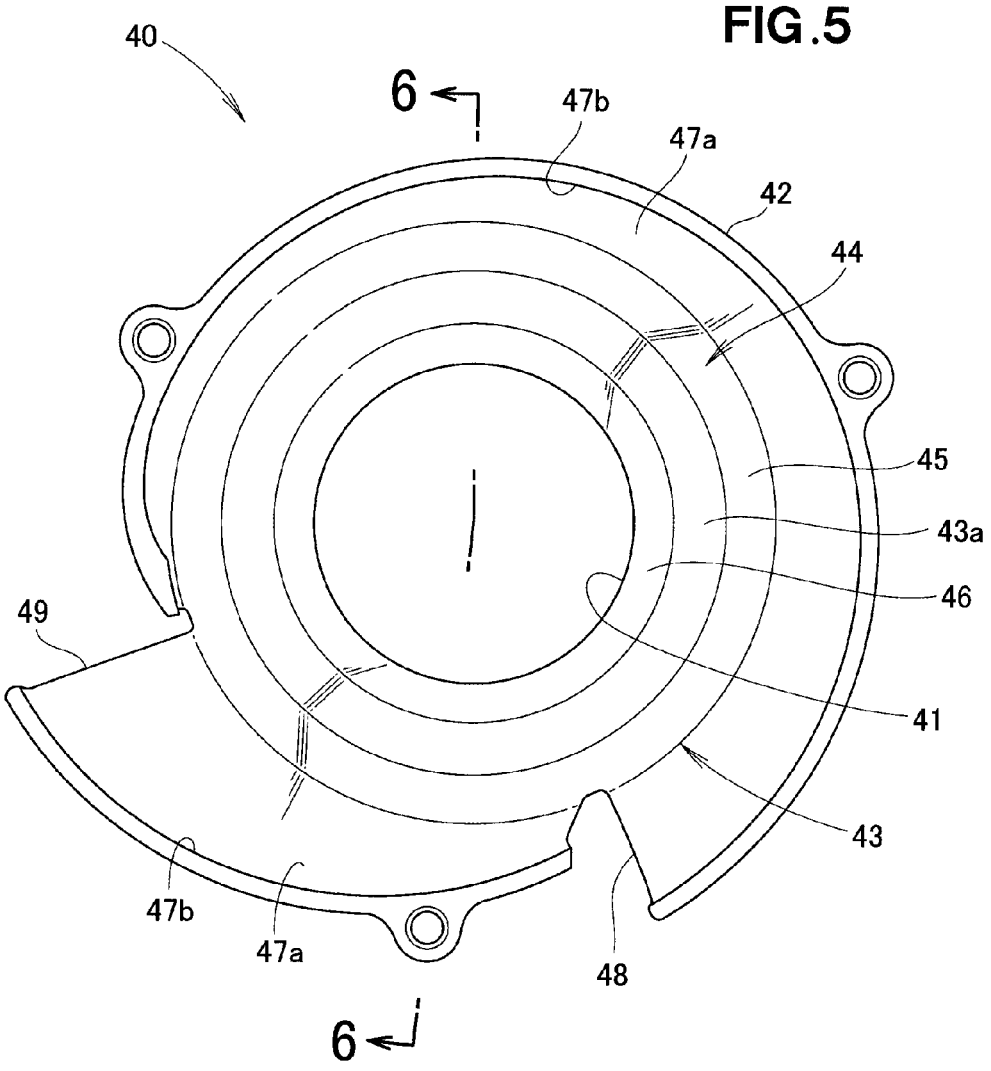
FIG. 5 is a rear view of a volute case shown in FIG. 4.
Figure 6:
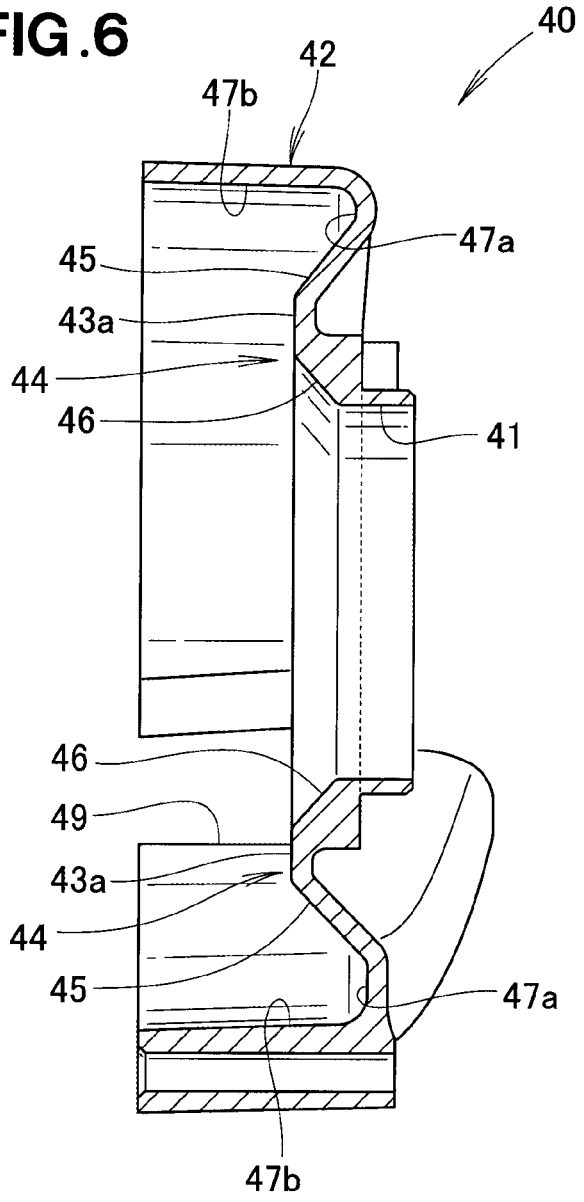
FIG. 6 is a sectional view taken along line 6-6 of FIG. 5.
Figure 7:
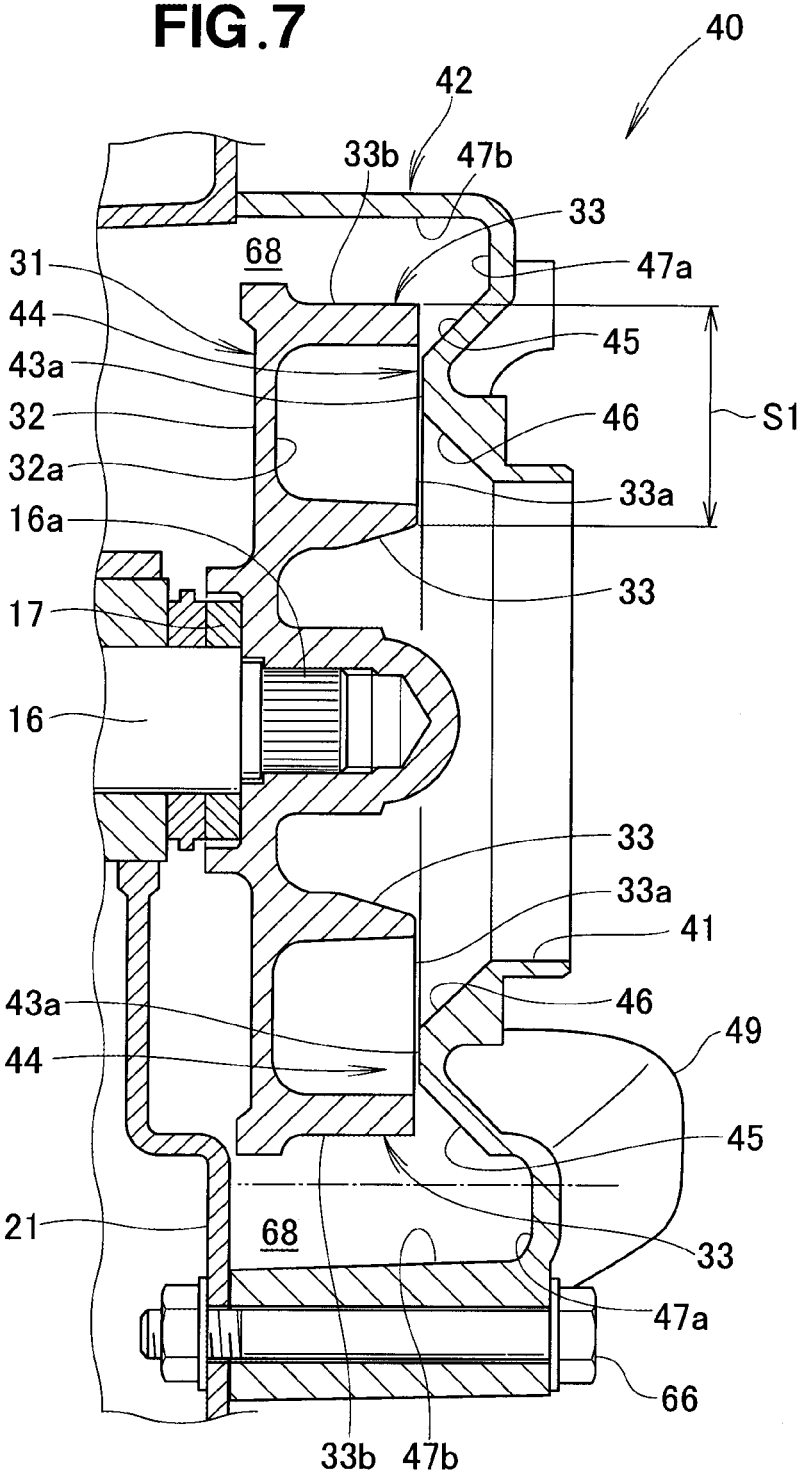
FIG. 7 is a sectional view taken along line 7-7 of FIG. 4.

Further, as shown in FIGS. 5 to 7, the opposed surface 43 of the volute 40 has a proximate section 44 proximate to the axial end surfaces 33*a* of the impeller 31. The proximate section 44 has an annular shape and is disposed about the rotation shaft 16. Thus, during rotation of the impeller 31, the axial end surfaces 33*a* of the impeller 31 are constantly kept close to the proximate section 44.

The proximate section 44 includes an outer peripheral portion 45 of an annular shape, a proximal opposed surface portion 43*a* of an annular shape disposed inward of the outer peripheral portion 45, and an inner peripheral portion 46 of an annular shape disposed inward of the opposed surface portion 43*a*. Thus, the proximate section 44 is constructed as a triple-ring structure as viewed in rear view.

The outer peripheral portion 45 of the proximate section 44 is formed in a tapered shape such that, within a range S1 of a rotational trajectory of each of the vanes 33, it gradually spreads out (or slants radially outward) in a direction axially away from each of the vanes 33, i.e. with an increasing distance from each of the vanes 33. Further, the inner peripheral portion 46 of the proximate section 44 is formed in a tapered shape such that, within the range S1 of the rotational trajectory of each of the vanes 33, it gradually tapers (i.e., slants radially inward) in the direction axially away from each of the vanes 33.

Further, the inner peripheral portion 46 and the outer peripheral portion 45 are spaced apart from each other with the opposed surface portion 43*a* disposed therebetween. The opposed surface portion 43*a* proximate to the tapered outer peripheral portion 45, the tapered inner peripheral portion 46 and the axial end surfaces 33*a* overlaps about one third of the range S1 of the rotational trajectory of each of the vanes 33.

Namely, the volute body 42 includes: the tapered inner peripheral portion 46 provided immediately adjacent to the volute suction opening 41; the opposed surface portion 43*a* formed continuously with the inner peripheral portion 46; the tapered outer peripheral portion 45 formed continuously with the opposed surface portion 43*a*; a spaced opposed surface 47*a* formed continuously with the outer peripheral portion 45 and spaced apart from the axial end surfaces 33*a*; and a peripheral wall 47*b* formed continuously with the spaced opposed surface 47*a* and surrounding the peripheral surfaces 33*b* of the vanes 33.

Next, a description will be given about behavior of the first embodiment of the centrifugal pump 20 constructed in the aforementioned manner.

Figure 8B:
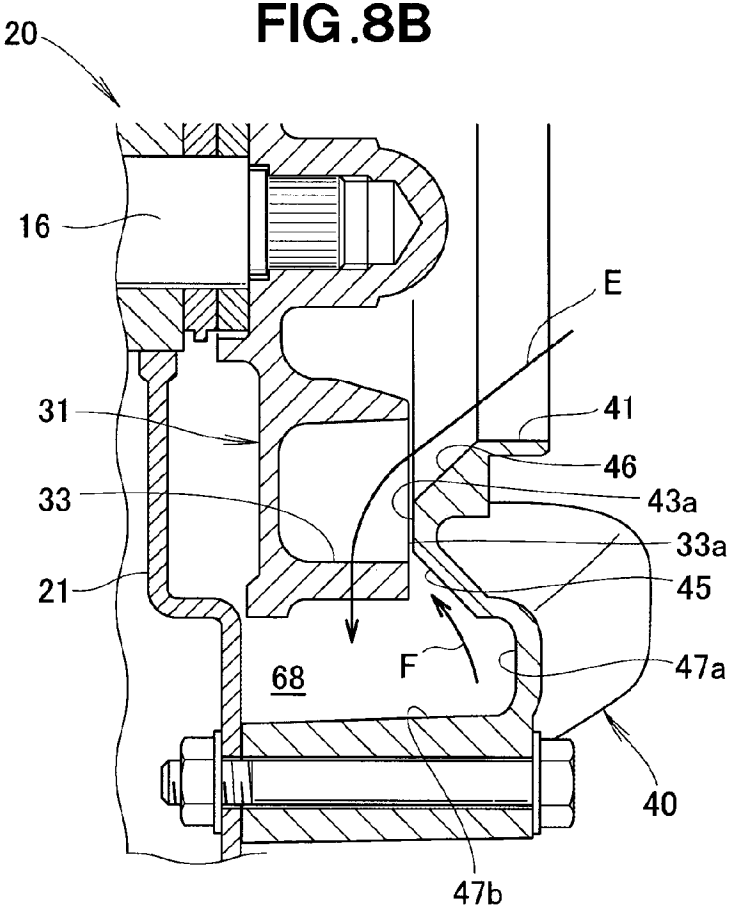
FIGS. 8A and 8B are views explanatory of behavior of a conventionally-known example of a centrifugal pump and behavior of the centrifugal pump according to the first embodiment of the present invention.
Figure 8A:
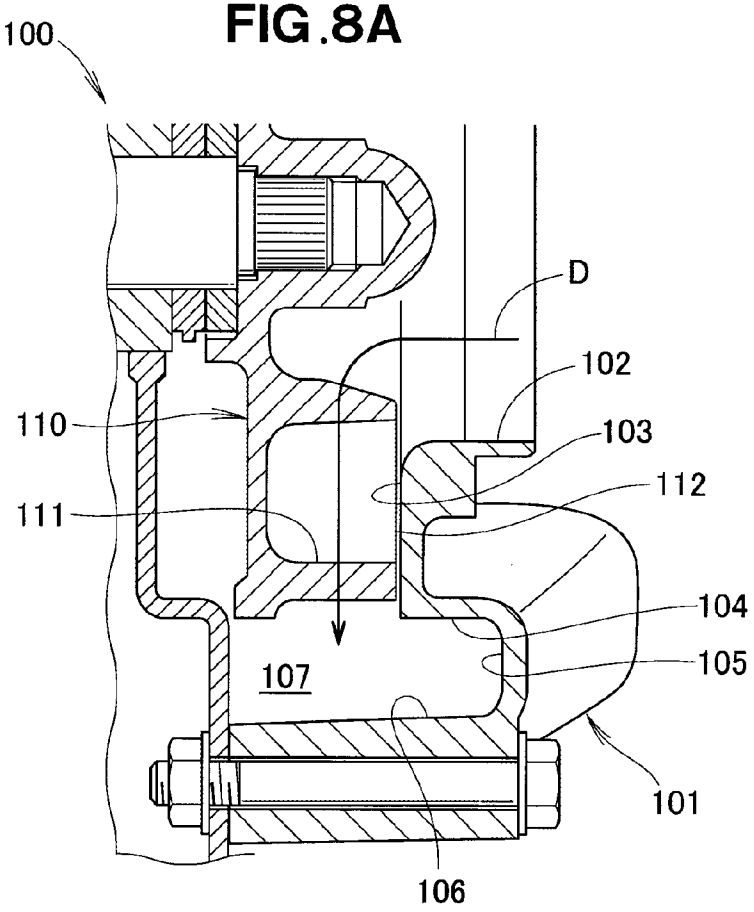

FIG. 8A is a view explanatory of a conventionally-known example of a centrifugal pump 100. A volute 101 in the conventionally-known example of the centrifugal pump 100 includes: a volute suction opening 102; a flat opposed surface 103 located immediately adjacent to an end portion of the volute suction opening 102; a vertical wall 104 formed continuously with the opposed surface 103; a spaced opposed surface 105 formed continuously with the vertical wall 104 and spaced apart from an impeller 110; and a peripheral wall 106 formed continuously with the spaced opposed surface 105 and surrounding the impeller 110.

During steady operation of the centrifugal pump 100, fluid flows through the volute suction opening 102 into an in-volute flow passage 107 as indicated by arrow D. Because the opposed surface 103 is located proximate to respective end surfaces 112, in a rotation axis direction, of individual vanes 111 (i.e., respective axial end surfaces 112 of the vanes 111) of the impeller 110, the fluid can be prevented from flowing back from the in-volute flow passage 107 to the volute suction opening 102. Although it is preferable that a flow passage from the volute suction opening 102 to the in-volute flow passage 107 be great in size, the overall size of the volute 101 has to be limited in order to avoid interference between the volute 101 and a pump casing surrounding the volute 101. In the conventionally-known example of the centrifugal pump 100, the flow rate of fluid cannot be increased because the flow passage has a small effective sectional area and has a bent shape.

FIG. 8B is a view explanatory of behavior of the first embodiment of the centrifugal pump 20 ("INVENTIVE EMBODIMENT"). In the embodiment of the centrifugal pump 20, the inner peripheral portion 46 of the volute 40 has a tapered shape (slants radially inward). Thus, during the steady operation of the centrifugal pump 20, fluid can smoothly flow through the volute suction opening 41 into the in-volute flow passage 68 as indicated by arrow E, but also the flow rate of the fluid can be increased. The outer peripheral portion 45 of the volute 40 also has a tapered shape (slants radially inward). Thus, the effective sectional area of the flow passage can be increased, so that the flow rate of the fluid can be even further increased. In this way, the embodiment of the centrifugal pump 20 can increase the flow rate without changing the overall size of the volute 40.

Further, during the self-priming operation of the centrifugal pump 20, the outer peripheral portion 45 of the tapered shape allows priming water to flow as indicated by arrow F so that feeding of the priming water and gas-liquid agitation can be significantly promoted. Consequently, an increased self-priming speed can be achieved. Further, because the opposed surface portion 43*a* proximate to the axial end surfaces 33*a* of the impeller 31 overlaps about one third of the range S1 shown in FIG. 7, the instant embodiment can prevent the fluid from flowing back from the in-volute flow passage 68 to the volute suction opening 41.

The following summarize the first embodiment of the centrifugal pump 10. As shown in FIGS. 5 and 7, the proximate section 44 has an annular shape and disposed about the rotation shaft 16. Because the outer peripheral portion 45 of the proximate section 44 has a tapered shape such that, within the range S1 of the rotational trajectory of each of the vanes 33, it gradually spreads out in the direction axially away from the vane 33, the outer peripheral portion 45 can provide an increased flow-passage sectional area. Further, with the outer peripheral portion 45 having such a tapered shape, the flow passage can be changed in direction smoothly, not at a steep angle. As a result, the instant embodiment permits efficient use of a space inside the volute 40 and an increased flow rate within the volute 40 while maintaining the overall size of the volute 40 (or without changing the overall size of the volute 40). Further, the priming water can be fed through the discharge opening 49 of the outer peripheral portion 45 with an increased ease, so that the gas-liquid agitation can be promoted to achieve enhanced self-priming.

Further, because the inner peripheral portion 46 of the proximate section 44 has a tapered shape such that, within the range S1 of the rotational trajectory of each of the vanes 33, it gradually tapers in the direction axially away from the vane 33 as shown in FIGS. 5 and 7, the inner peripheral portion 46 can provide an increased flow-passage sectional area. Further, with the inner peripheral portion 46 having such a tapered shape, the flow passage can be changed in direction smoothly, not at a steep angle. As a result, the instant embodiment permits efficient use of the space inside the volute 40 and an increased flow rate within the volute 40 to thereby realize even further enhanced self-priming. Further, because the inner peripheral portion 46 and the outer peripheral portion 45 are spaced apart from each other with the proximate opposed surface portion 43*a* disposed therebetween, the proximate section 44 disposed within the range S1 of the rotational trajectory of each of the vanes 33 can prevent the fluid from flowing backward. As a result, the instant embodiment can prevent variation in discharge pump head.

Next, a description will be given about a second embodiment of the centrifugal pump of the present invention with reference to FIGS. 9 and 10, where the same elements as those in FIG. 7 are indicated by the same reference numerals and will not be described to avoid unnecessary duplication.

Figure 9:
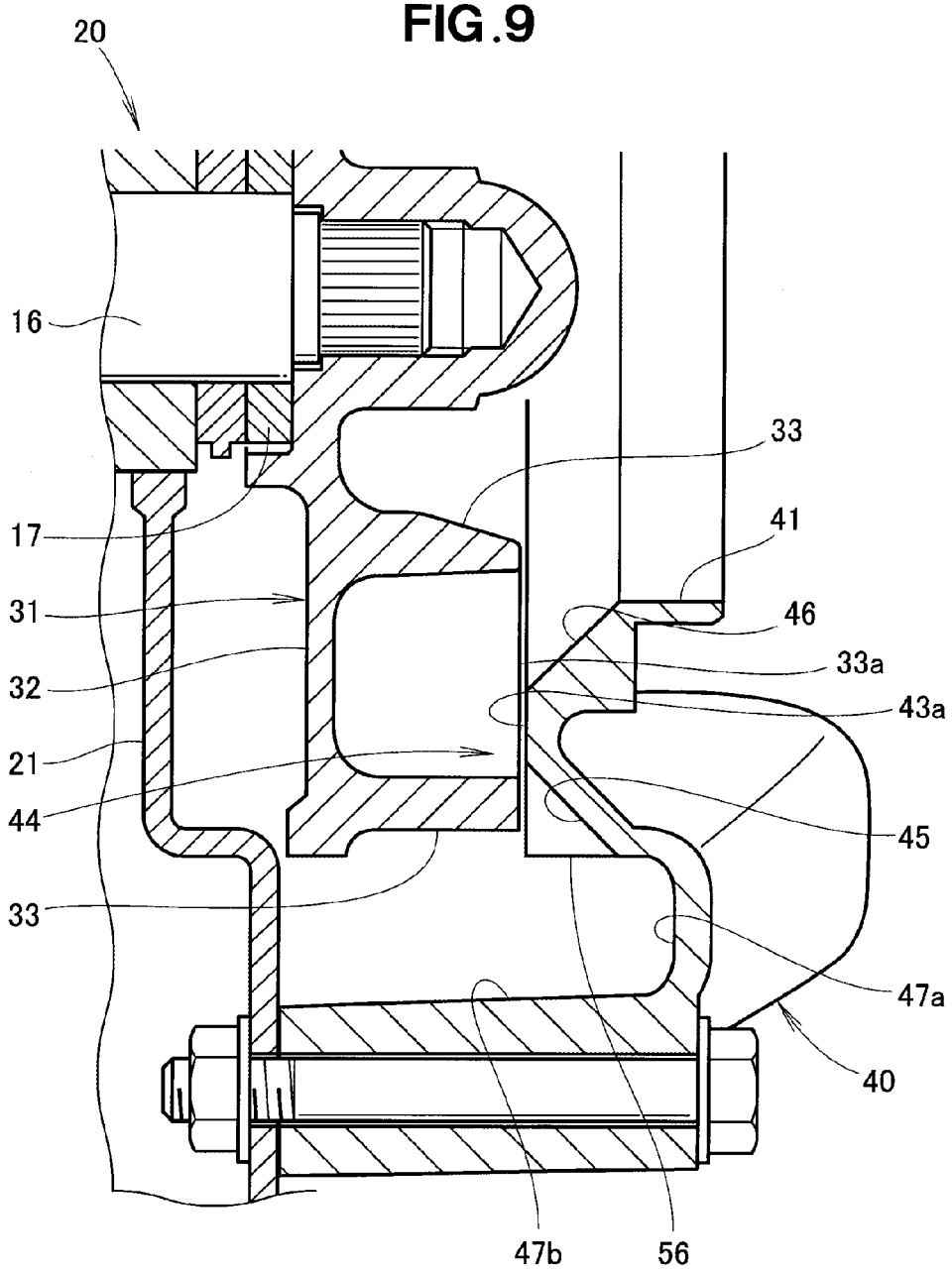
FIG. 9 is a sectional view showing a centrifugal pump according to a second embodiment of the present invention.
Figure 10:
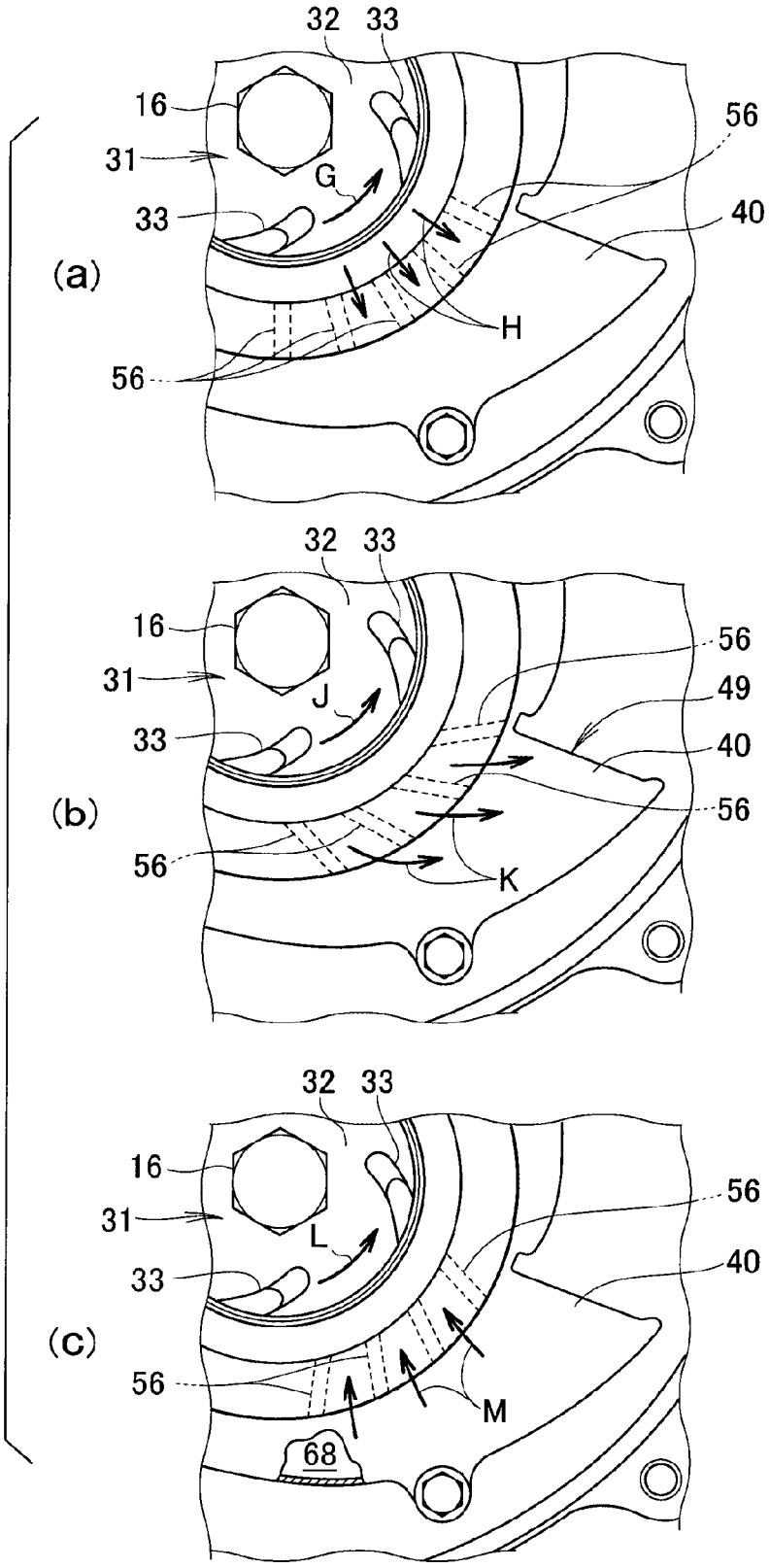
FIG. 10 is a view explanatory of behavior of the second embodiment of the centrifugal pump shown in FIG. 9.

As shown in FIGS. 9 and 10, a plurality of fins 56 projecting toward the impeller 31 are provided on the tapered outer peripheral portion 45 of the proximate section 44. The fins 56 are arranged radially about the rotation shaft 16.

As shown in (a) of FIG. 10, the fins 56 are provided to extend straight radially outward away from the rotation shaft 16. Thus, as the impeller 16 rotates as indicated by arrow G, fluid is straightened by the fins 16 to flow as indicated by arrow H, so that the flow rate of the fluid can be increased.

As shown in (b) of FIG. 10, the fins 56 may be provided to extend slanted, in the rotating direction of the impeller 31, with respect to a normal line extending straight radially outward from the rotation shaft 16. As the impeller 16 rotates as indicated by arrow J, fluid is straightened by the fins 56 and flows toward the volute discharge opening 49 as indicated by arrow K. Thus, the fluid can be readily discharged through the volute discharge opening 49, as a result of which the flow rate of the fluid can be significantly increased.

Further, as shown in (c) of FIG. 10, the fins 56 may be provided to extend slanted, in a direction opposite the rotating direction of the impeller 31, with respect to the normal line extending straight radially outward from the rotation shaft 16. As the impeller 16 rotates as indicated by arrow L during self-pumping of the pump, pumping water in the in-volute passage 68 flows toward the rotating direction of the impeller 31 as indicated by arrow M. Thus, the second embodiment can increase the flow rate of the pumping water and thereby increase the self-pumping speed.

Furthermore, the maximum pump head can be enhanced by increasing the density of the fins 56, and self-pumping performance can be enhanced by decreasing the density of the fins 56. Thus, the centrifugal pump 20 can be adjusted with ease in accordance with a desired purpose.

The following summarize the second embodiment of the centrifugal pump 20. As shown in FIGS. 9 and 10, the plurality of fins 56 projecting toward the impeller 31 are provided on the tapered outer peripheral portion 45 of the proximate section 44. Because the fins 56 are provided in a radial arrangement about the rotation shaft 16, the fluid can be straightened by the fins 16, so that flows of the fluid can be smoothed. As a result, the second embodiment can lower resistance of the flow passage and reduce a load on a drive source that rotates the impeller 31.

Whereas the outer peripheral portion 45 has been described above as having a straight sectional shape and formed in a tapered shape such that it gradually spreads out in the direction axially away from each of the vanes 33, the present invention is not so limited, and the outer peripheral portion 45 may have a curved sectional shape. Further, the inner peripheral portion 46 has been described above as having a straight sectional shape and formed in a tapered shape such that it gradually tapers in the direction axially away from each of the vanes 33, the present invention is not so limited, and the inner peripheral portion 46 may have a curved sectional shape.

The basic principles of the present disclosure are well suited for application to centrifugal pumps which include an impeller within a volute and in which fluid sucked into the volute by rotation of the impeller is sent out along the volute and the sent-out fluid is discharged to outside of the centrifugal pump.

What is claimed is:

1. A centrifugal pump comprising:

a volute provided within a pump casing; and an impeller rotatably provided within the volute, wherein fluid sucked into the volute by rotation of the impeller is sent out from the volute into the pump casing and then discharged to outside of the pump casing, the impeller having a plurality of vanes provided thereon in a radial arrangement about a rotation shaft that rotates the impeller, the volute having a generally flat opposed surface that is opposed to respective axial end surfaces of the plurality of vanes, the opposed surface having a proximate section that is proximate to the axial end surface of each of the vanes, the proximate section having an annular shape and being disposed about the rotation shaft, the proximate section including an outer peripheral portion having a tapered shape such that, within a range of a rotational trajectory of each of the vanes, the outer peripheral portion gradually spreads out in a direction along the rotation shaft away from the vane and separates from the vane as the outer peripheral portion separates from the rotation shaft in a radial direction of the rotation shaft, and of the proximate section, the outer peripheral portion having the tapered shape has a plurality of fins provided thereon in a radial arrangement about the rotation shaft and projecting toward the impeller from the outer peripheral portion having the tapered shape.

2. The centrifugal pump according to claim 1, wherein the proximate section also includes an inner peripheral portion having a tapered shape such that, within the range of the rotational trajectory of each of the vanes, the inner peripheral portion tapers in the direction axially away from the vane, and the inner peripheral portion and the outer peripheral portion of the proximate section are spaced apart from each other with a flat proximal opposed surface portion disposed therebetween.

* * * * *